US005417227A

United States Patent [19]

West

[11] Patent Number: 5,417,227

[45] Date of Patent: May 23, 1995

[54] SMOKER'S PIPE

[76] Inventor: Keith H. West, 235 S. Broadway, #505, Tacoma, Wash. 98401

[21] Appl. No.: 253,705

[22] Filed: Jun. 3, 1994

Related U.S. Application Data

[63] Continuation of Ser. No. 947,406, Sep. 9, 1993, abandoned.

[51] Int. Cl.[6] ..... A24F 1/02

[52] U.S. Cl. ..... 131/185; 131/198.2; 131/226

[58] Field of Search ..... 131/178, 185, 186, 193, 131/198.1, 198.2, 222, 224, 226

[56] References Cited

U.S. PATENT DOCUMENTS

| | | | |
|---|---|---|---|
| 793,565 | 6/1905 | Campbell . | |
| 1,336,233 | 4/1920 | Ivory . | |
| 1,976,496 | 10/1934 | Harris . | |
| 2,398,695 | 4/1946 | Cloutier | 131/185 |
| 2,467,002 | 4/1949 | Atkins | 131/198 |
| 2,549,727 | 4/1951 | Van Toll | 131/185 |
| 3,882,876 | 5/1975 | Covington | 131/185 |
| 4,276,892 | 7/1981 | Iaquinta | 131/185 |
| 4,649,945 | 3/1987 | Norman et al. | 131/336 |
| 4,774,970 | 10/1988 | Bell | 131/175 |
| 4,809,718 | 3/1989 | Deal | 131/336 |

*Primary Examiner*—Vincent Millin
*Assistant Examiner*—William M. Pierce
*Attorney, Agent, or Firm*—Delbert J. Barnard

[57] ABSTRACT

A smoker's pipe (10) has a section (22) which is rotatable relative to a section (66). A combustion chamber is formed by and between the two sections (22, 66). A tobacco holder (36) or a cigarette (C) is located within the pipe(10). A movable portion of a lighter unit (44) is moved axially inwardly of the pipe (10) while a mouthpiece (12) at the opposite end of the pipe (10) is within the user's mouth. This movement of the lighter unit part creates a flame (F) which is directed axially inwardly into the pipe bowl, to ignite the tobacco (T) within the tobacco holder (36) or a cigarette (C) in place of the tobacco holder (36). When it is desired to extinguish combustion, pipe section (22) is rotated relative to pipe section (66). This closes off air supply openings (16) and air supply passageways (42). The user can continue smoking the pipe (10) until combustion is completely extinguished.

17 Claims, 3 Drawing Sheets

SMOKER'S PIPE

This application is a continuation of application Ser. No. 07/947,406, filed Sep. 9, 1993, now abandoned.

TECHNICAL FIELD

This invention relates to a smoker's pipe. More particularly, it relates to the provision of a new and unique smoker's pipe which is adapted for quick and easy ignition of tobacco within a combustion chamber, quick and easy extinguishing of combustion, and a capability of use with little discharge of smoke to the atmosphere.

BACKGROUND OF THE INVENTION

Known smoker's pipes include a bowl in which tobacco is burned connected to a mouthpiece by a stem. Examples of pipes which can be found in the patent literature are U.S. Pat. No. 793,565; granted Jun. 27, 1905, to George G. Campbell; U.S. Pat. No. 1,336,233, granted Apr. 6, 1920, to James W. Ivory; U.S. Pat. No. 1,976,496, granted Oct. 9, 1934, to Samuel J. Harris; U.S. Pat. No. 2,467,002, granted Apr. 12, 1949, to Samuel L. Atkins; U.S. Pat. No. 2,549,727, granted Apr. 17, 1951, to John Van Toll; U.S. Pat. No. 3,882,876, granted May 13, 1975, to Edwin G. Covington; U.S. Pat. No. 4,276,892, granted Jul. 7, 1981, to Joseph Iaquinta and U.S. Pat. No. 4,774,970, granted Oct. 4, 1988, to Douglas W. Bell.

The objectives of Douglas W. Bell, set forth in his U.S. Pat. No. 4,774,970, are similar to my objectives but the smoking appliance or pipe disclosed in U.S. Pat. No. 4,774,970 is quite different from my smoking appliance or pipe. U.S. Pat. Nos. 2,549,727; 3,882,876; 4,276,892 and 4,774,970 are relevant to my invention in a very limited way because each discloses building a tobacco lighter into a smoking pipe. However, none of the pipes disclosed by these patents bears any resemblance to my pipe.

A main object of the present invention is to provide a smoker's pipe having a combustion chamber which can be easily closed to atmospheric air for the purpose of quickly extinguishing combustion. Another object of the invention is to provide a pipe which can be used for short duration smoking in crowded areas with a minimum of smoke discharge into the atmosphere. A further object of my invention is to provide a pipe into which has been incorporated a commercially available lighter of a type which initiates combustion by a simple endwise push on the lighter body.

DISCLOSURE OF THE INVENTION

A smoker's pipe constructed according to the present invention is basically characterized by a first axial section which includes a bowl having a tubular sidewall, a sidewall opening in said sidewall, a tubular stem connected to the bowl, and a tubular mouthpiece connected to a tubular stem. This pipe is further characterized by a second axial section comprising an elongated main body sleeve having a bowl end portion surrounding said bowl. The sleeve also includes a sidewall with a side opening and a closed wall portion. The bowl is rotatable with respect to the sleeve between a position in which the side opening in the sleeve is in alignment with the side opening of the sidewall of the bowl, and a position in which the closed wall portion of the sleeve covers and thus closes the side opening in the sidewall of the bowl.

In preferred form, the stem includes a tobacco holder which extends axially into the bowl. The tubular sidewall of the bowl preferably includes a portion concentrically surrounding the tobacco holder. An annular air supply space is defined radially between the tobacco holder and the tubular sidewall of the bowl. The pipe includes at least one air passageway connecting said air supply space with the atmosphere. The sleeve includes a sidewall opening that is in alignment with the air passageway when the side opening in the sleeve is in alignment with the side opening of the sidewall of the bowl, and a closed portion which covers said air passageway when the closed wall portion of the sleeve covers the side opening in the sidewall of the bowl.

According to one aspect of the invention, the main body sleeve includes an outer end portion which extends axially outwardly from said bowl. A lighter is housed within the outer end of the sleeve. The lighter includes a fixed portion and an axially movable portion. The axially movable portion extends endwise outwardly from the bowl. An endwise inward push on the axially movable portion of the lighter will move such portion relative to the fixed portion, to ignite the flame that is directed axially inwardly of the bowl. A user may align the sidewall opening in the sleeve with the sidewall opening in the bowl, to insert tobacco into the tobacco holder, and push inwardly on the movable portion of the igniter, to create a flame for igniting the tobacco. Then, when it is desired to extinguish the pipe, the user need only rotate the stem and bowl section of the pipe relative to the sleeve and igniter section of the pipe, to move a closed wall portion of the sleeve over the sidewall opening in the bowl, to cut off ambient air supply to the bowl. The user may then continue to draw from the pipe until combustion stops.

Another object of the invention is to provide a smoker's pipe which includes an elongated tubular body having a mouthpiece end and a lighter end. A tubular mouthpiece is located at the mouthpiece end of the body and a lighter is located at the lighter end of the body. The body defines a bowl intermediate the body. The bowl is axially between and in axial alignment with the mouthpiece and the lighter. The bowl has a side opening. The lighter has a fixed portion that is anchored within the body adjacent the bowl. It also has an axially movable portion adapted to be moved axially inwardly of the pipe. In response to such movement, the lighter is adapted to create a frame for igniting tobacco within the pole. Preferably, the axially movable portion of the lighter is elongated. The body includes a bushing at the lighter end of the body into which such movable portion is received. An outer end part of the movable portion projects endwise outwardly from said bushing, into a position to be pushed upon by a user, to ignite the lighter.

A further object of the invention is to provide a smoker's pipe that includes an elongated pipe body having a mouthpiece at one end, an opposite end which is closed, a, pipe bowl between the two ends, and a side opening in the body extending outwardly from said bowl. A tubular tobacco holder is positioned within the pipe bowl. The tobacco holder is connected with the mouthpiece by a passageway. The body includes a sidewall which surrounds the tobacco holder. This sidewall and the tobacco holder together define radially between them an annular air chamber. The body includes at least one air passageway leading into the annular air chamber, at a location spaced axially of the pipe from the sidewall opening. In preferred form, a lighter is provided at the second end of the pipe, axially outwardly from the bowl. The lighter has a first portion that is fixed in position relative to the body and an axially movable second portion. The second portion is movable axially inwardly to create a frame which is directed into the bowl towards the tobacco holder, for igniting tobacco held by the tobacco holder.

Other objects, features and advantages of the invention will be hereinafter described in the description of the best mode.

BRIEF DESCRIPTION OF THE DRAWINGS

Like reference numerals are used to designate like parts throughout the several views of the drawing, and.

BEST MODE FOR CARRYING OUT THE INVENTION

Figures 1, 2, 3, 4, 5:
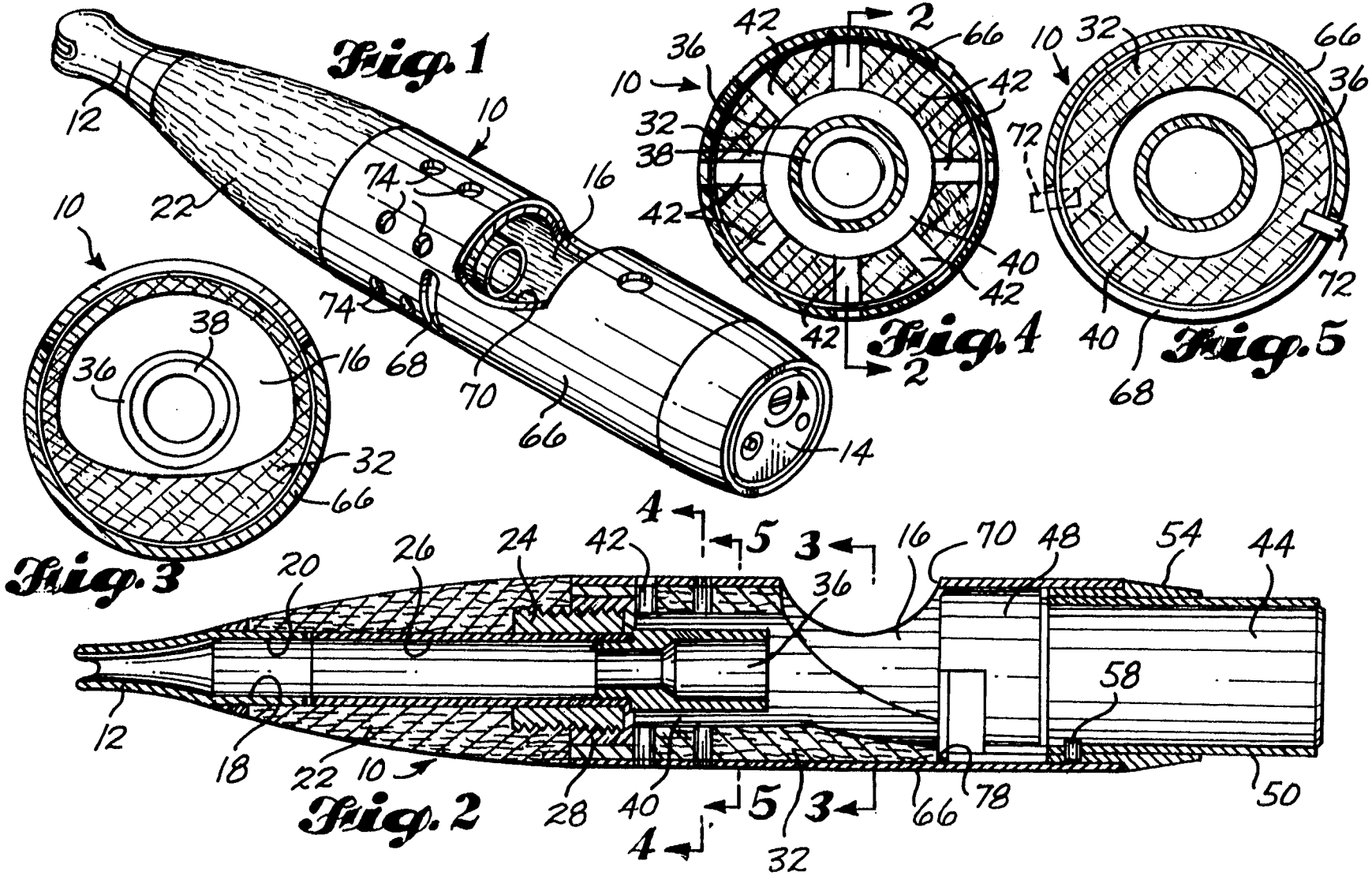
FIG. 1 is a pictorial view of a pipe embodying the present invention, such view being taken from above and looking towards one side and the outer end of the pipe, with a closure for the combustion chamber being shown in an open position.
FIG. 2 is an axial sectional view taken through the pipe substantially along line 2—2 of FIG. 4.
FIG. 3 is a cross-sectional view taken substantially along line 3—3 of FIGS. 2 and 7.
FIG. 4 is a cross-sectional view taken substantially along line 4—4 of FIGS. 2 and 7.
FIG. 5 is a cross-sectional view taken substantially along line 5—5 of FIGS. 2 and 9.
Figures 6, 10:
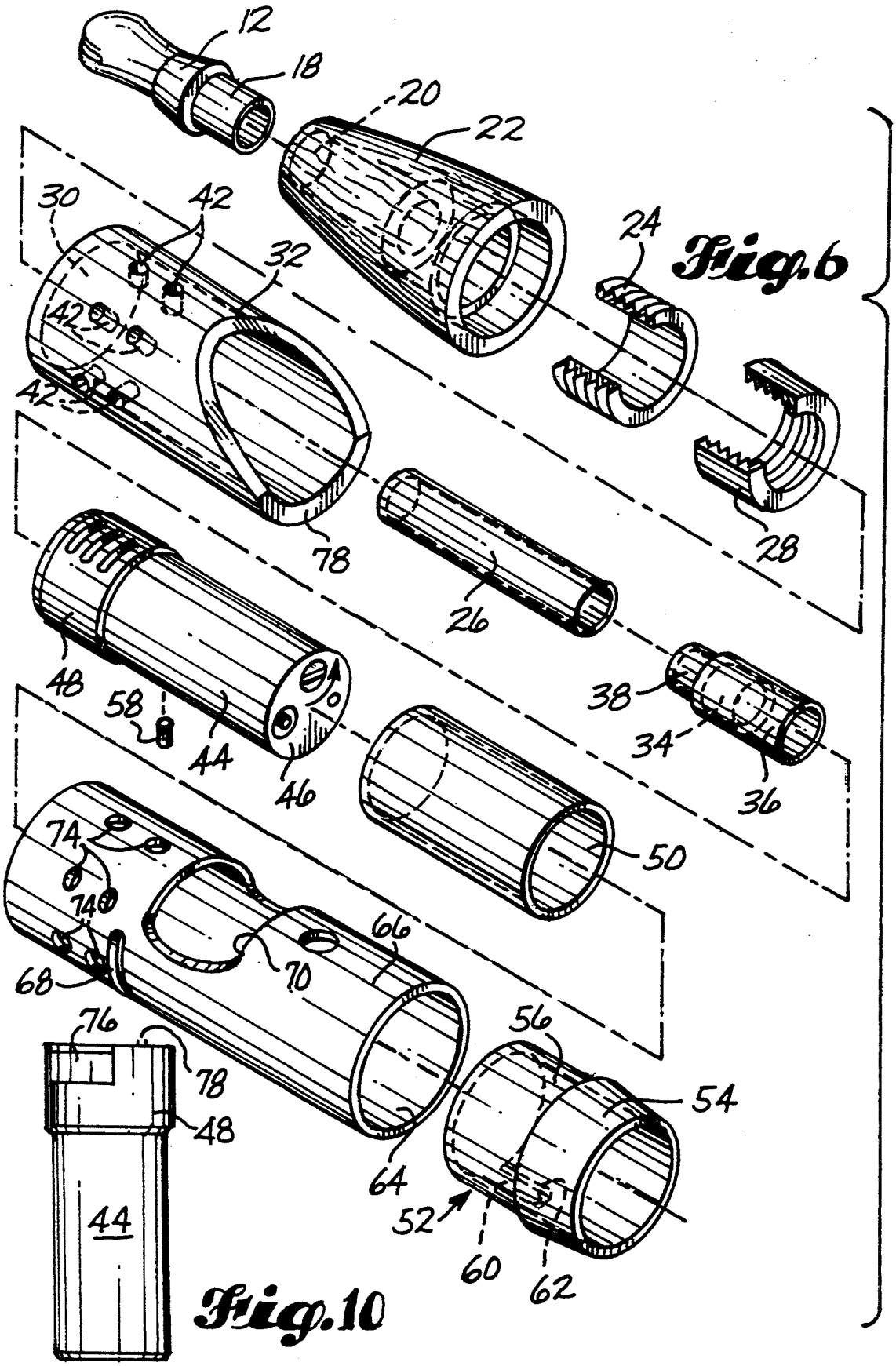
FIG. 6 is an exploded pictorial view of the pipe shown by FIGS. 1–5 and 7–9.
FIG. 10 is a side elevational view of a lighter detached from the pipe.

In preferred form, a pipe 10 constructed according to the present invention includes a mouthpiece 12 at one end, a lighter 14 at its opposite or outer end, and a combustion chamber 16 between its ends. As best shown by FIG. 6, mouthpiece 12 may include a tubular section 18 which is pluggable into end 20 of a stem 22. Stem 22 includes a stepped central passageway into which is fitted a sleeve 24 and a tube 26. The inner end of tube 26 abuts the outer end of mouthpiece section 18 (FIG. 2, for example). The outer end of tube 26 extends into sleeve 24 (FIG. 2, for example). A second sleeve 28 is received within the inner end 30 of a bowl 32. As shown in FIG. 2, for example, internal threads in sleeve 28 mate with external threads on sleeve 24. This secures the stem 22 and mouthpiece 20 to the bowl 32.

A tobacco holder 34 is secured to the outer end of the tube 26. Tobacco holder 34 may include a tubular body 36 and a reduced diameter stem 38 which plugs into the outer end of tube 26. When these parts are installed, the tubular body 36 is positioned within the bowl 32. Body 36 opens towards the combustion chamber 16 and is surrounded by an annular air supply chamber 40. Radial openings 42 extend through the bowl member 32 and supply ambient air to the air supply chamber 40.

A lighter 44 includes a fuel storage body 46 which fits within a sleeve 50. Lighter 44 includes an inner end part 48 which is fixed in position relative to lighter part 46. Sleeve 50 extends through a bushing 52. Bushing 52 has an outer end portion 54 and an inner end portion 56. A radial shoulder is formed between portions 54 and 56. As shown by FIG. 2, lighter part 44 is secured to sleeve 50 by a pin 58. Pin 58 extends through a hole in sleeve 50 (FIG. 2) and then fit snugly into a socket formed in lighter part 44. An outer end portion of pin 58 fits within an axial slot 60. Slot 60 has a closed outer end 62 which prevents endwise movement of the lighter 44 and the sleeve 50 out from bushing 54. Bushing section 56 makes a tight interference fit with the outer end portion 64 of a main body sleeve 66. When bushing section 52 is within end portion 64 the main body sleeve 66 is firmly connected to sleeve 54. Main body sleeve 66 fits over bowl 32 and over the outer end portion of stem 22. Main body sleeve 66 includes a circumferentially extending slot 68 and a side opening 70. Slot 68 includes two closed ends (FIG. 5). A lock pin 72 (FIG. 5) extends through slot 68 and into bowl 32 (FIG. 5). Pin 72 prevents axial movement of main sleeve 66 relative to the assembly of mouthpiece 12, stem 22, rings 24, 28 and bowl 34. Rotation of assembly 12, 22, 24, 28, 32 relative to sleeve 66 is permitted between the ends of the slot 68. When pin 72 is against one end of slot 68, a sidewall portion of sleeve 66 closes bowl opening 16 (FIG. 5). When pin 72 is against the opposite end of slot 68 the sleeve opening 70 is in registry with the bowling opening 16 (FIGS. 1–3). Also, sidewall openings 74 in sleeve 66 are in alignment with passageways 42 in member 32. When sleeve 66 is in its FIG. 5 position, the openings 74 are out of alignment with the passageways 42. The passageways 42 are closed by wall portions of sleeve 66 between openings 74.

The lighter part 44 is a commercially available unit. It is a part of a lighter named "lipstick lighter" which is sold by the KGM Lighter Co., having offices in Los Angeles, Calif. FIG. 10 shows the lighter part 44 in its natural (vertical) attitude. In its customary use, the body of lighter part 44 is located within a casing (not shown) which is held in the user's hand. The user places his or her thumb on part 76 which is movable relative to the lighter body. Thumb pressure is used to push down on part 76. In response, a flame is created at 78. The lighter unit per se is not a part of the present invention. Since this component is per se known, it will not be described in greater detail.

As shown by FIGS. 2 and 7–9, when the lighter unit 44 is within the pipe 10, the member 76 is against end surface 78 of member 32. Member 76 becomes relatively fixed while the rest of the igniter unit 44 is relatively movable. As stated above, the body portion of lighter unit 44 fits within cylindrical member 50. Pin 72 is inserted through a side opening in member 50 and into a socket formed in the body of lighter unit 44. Pin 72 connects lighter unit 44 to the member 50. Pin 72 also fits down into slot 60 and serves as a guide for the movable portion of lighter unit 44.

Figures 7, 8, 9:
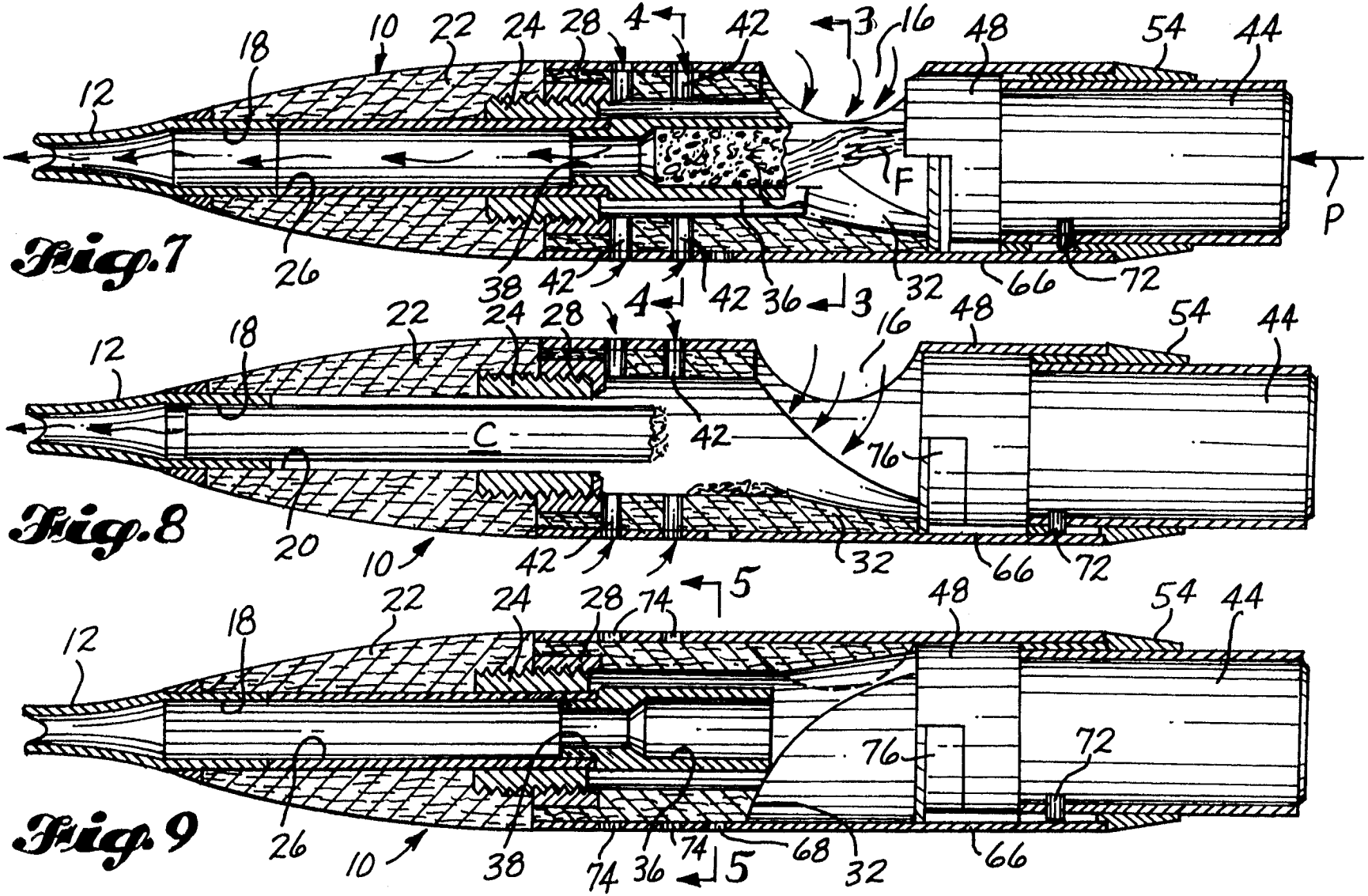
FIG. 7 is a view like FIG. 2, showing a shortened cigarette being held by a cigarette holder in the combustion chamber.
FIG. 8 is a view like FIG. 2, showing tobacco within a pipe bowl that is located within the combustion chamber.
FIG. 9 is a view like FIG. 2, but showing the combustion chamber closure rotated into a closed position.

FIG. 7 shows tobacco T within the tobacco holder 36. It also shows, by an arrow P, a push being applied to the movable portion of the lighter unit 44. Lighter part 76 does not move because it contacts end wall 78 of part 32. However, the rest of lighter unit 44 moves axially inwardly relative to part 76. As known per se, this movement causes ignition of fuel and creation of flame F. The flame F is directed towards the tobacco T in the tobacco holder 36. Upon a release of the push force applied to the movable part of lighter unit 44, a spring within the lighter unit 44 moves the movable portion of the unit back out to its at rest position (FIGS. 8 and 9, for example). In response to this movement, the flame F is extinguished. Air enters the bowl through opening 16. Secondary air enters through openings 74 and passageways 42. The user places the mouthpiece 12 into his or her mouth and draws on the pipe 10, to draw smoke into his or her mouth. Use of the pipe in this manner is continued until the tobacco T is completely consumed, or until the user desires to stop smoking. In the latter event, the user rotates pipe part 22 relative to sleeve 66, until the openings 70 in sleeve 66 is out of registry with opening 66, and openings 74 in sleeve 76 are out of registry with passageways 42 (FIG. 9). This places closed sidewall portions of the sleeve 66 over openings 16 and passageways 42. It shuts off ambient airflow to the pipe bowl and results in combustion being extinguished. The user can continue to use the pipe and draw smoke through stem 12 until burning of the tobacco T is stopped.

According to an aspect of the invention, the tobacco holder 36 can be removed and the pipe can be used as a cigarette holder. The removal and installation of tobacco holder 36 requires a partial dissassembly of the pipe 10. This is accomplished by first pulling out the pin 72 (FIG. 5). When pin 72 is removed, the sleeve 66, and the components connected to it, can be moved endwise away from pipe parts 22 and 32. Then, pipe part 32 can be disconnected from pipe part 22, by rotating part 32 relative to part 22. This causes an unthreading of ring 28 from ring 24. When the members 22, 32 are separated, the tobacco holder 36 can be either installed or removed, whichever be the case. FIG. 8 shows the tobacco holder 36 removed and a cigarette C inserted into the stem part 18. The cigarette C is inserted when the parts 22, 32 are disconnected. Then, part 32 is reattached to part 22. Then, sleeve 66 is moved endwise over part 32 and the pin 72 is installed. The pipe 10 is now ready to be used. The movable portion of lighter unit 44 is pushed inwardly of the pipe to ignite the cigarette C. Combustion of the cigarette C can be also quickly and easily extinguished, by a rotation of pipe part 22 relative to sleeve 22, to place these parts into the position shown by FIG. 9.

Pipe parts 22, 32 can be constructed from wood, plastic, bone, ceramic, or many other materials. Pipe parts 24, 26, 38, 66, 54, 50 are preferably constructed from metal. However, some or all of these parts can be constructed from plastic or other suitable materials that presently exist or may be developed in the future.

The illustrated embodiment provides an example of the invention. The protection is not to be directly limited by the details of the embodiment, but is to be determined by the following claims, interpreted by use of the prevailing rules of patent claim interpretation, including use of the doctrine of equivalents.

What is claimed is:

1. A smoker's pipe, comprising:

an elongated tubular body having a mouthpiece end and a lighter end;

a tubular mouthpiece at the mouthpiece end of the body;

a lighter at the lighter end of the body;

said body defining a combustion chamber intermediate the body, axially between and in axial alignment with the mouthpiece and the lighter, said tubular body having a side opening; and said lighter having an inner first portion axially fixed in position within said tubular body axially adjacent said combustion chamber, a second portion movable axially inwardly towards the combustion chamber and means for in response to such movement creating a flame directed axially inwardly into the combustion chamber for igniting tobacco within the combustion chamber.

2. A smoker's pipe according to claim 1, wherein the axially movable second portion of the lighter is elongated, wherein said lighter includes a bushing at the lighter end of the body into which said movable second portion is received, and wherein an outer end part of said movable second portion projects endwise outwardly from said bushing, into a position to be pushed upon by a user, to ignite the lighter.

3. A smoker's pipe, comprising:

an elongated pipe body having a mouthpiece end and an opposite end which is closed, and a combustion chamber between said ends, said pipe body having a side opening extending outwardly from said combustion chamber;

a tubular tobacco holder within said combustion chamber, said tobacco holder being connected with the mouthpiece by a passageway;

said pipe body having a tubular sidewall which surrounds the combustion chamber and the tobacco holder, said tubular sidewall being larger in diameter than the tubular tobacco holder;

said tubular sidewall and said tubular tobacco holder defining radially between them an annular air chamber;

said pipe body including at least one air passageway leading into said annular air chamber, at a location spaced axially of the pipe from the sidewall opening; and a lighter at the second end of the pipe body positioned axially outwardly from the combustion chamber, said lighter having a first portion that is fixed in position relative to the pipe body and an axially movable second portion, said second portion being movable axially inwardly to create a flame which is directed axially into the combustion chamber towards the tobacco holder, for igniting tobacco held by the tobacco holder.

4. A smoker's pipe, comprising:

a first axial section including a tubular sidewall defining and interior burning zone for tobacco, a tubular stem connected to the tubular sidewall, and a tubular mouthpiece connected to the tubular stem, said tubular sidewall including at least one opening;

a second axial section comprising a closed first end and an elongated sleeve at an opposite end which surrounds the tubular sidewall of the first axial section, said elongated sleeve also having a sidewall which includes an opening corresponding to each opening in the tubular sidewall, and a closed wall portion; and means connecting the first and second axial sections together for relative rotation, so that the first axial section can be rotated relative to the second axial section, between an open first position in which each opening in the sidewall of the sleeve is in alignment with its corresponding opening in the sidewall of the first axial section, and ambient air is allowed to enter through the aligned openings into the burning zone for tobacco to support combustion of tobacco in said burning zone, and a closed second position in which the closed wall portion of the sleeve covers and substantially closes each opening in the sidewall of the first axial section, and substantially prevents ambient air from entering into the burning zone.

5. A smoker's pipe according to claim 4, wherein said stem includes a tobacco holder that extends axially into the interior burning zone for tobacco.

6. A smoker's pipe according to claim 5, wherein the tubular sidewall of the first axial section includes a portion concentrically surrounding the tobacco holder that is larger in diameter than the tobacco holder, and an annular air supply space is defined radially between the tobacco holder and the tubular sidewall of the first axial section.

7. A smoker's pipe according to claim 6, wherein said tubular side wall includes an air passageway and said elongated sleeve includes a sidewall opening that is in alignment with said air passageway when the opening in the elongated sleeve is in alignment with the opening in the tubular sidewall of the first axial section, and a closed portion which covers said air passageway when the closed wall portion of the elongated sleeve covers the opening in the tubular sidewall of the first axial section.

8. A smoker's pipe according to claim 4, comprising a threaded connection between said first axial section and said stem.

9. A smoker's pipe according to claim 4, wherein said elongated sleeve includes an outer end portion which extends axially outwardly from said burning zone, and said pipe further includes a lighter housed within the outer end portion of the elongated sleeve, said lighter including a fixed portion and an axially movable portion, said axially movable portion extending endwise outwardly from the burning zone, wherein an endwise inward push on the axially movable portion of the lighter will move such portion relative to the fixed portion, to ignite a flame, and wherein said flame extends axially inwardly into the burning zone for tobacco.

10. A smoker's pipe according to claim 9, further comprising a tubular bushing connected to the outer end portion of the elongated sleeve, wherein the movable portion of the lighter is positioned within and guided for movement by said bushing.

11. A smoker's pipe according to claim 9, wherein said stem includes a tobacco holder which extends axially into the burning zone for tobacco.

12. A smoker's pipe according to claim 11, wherein the tubular sidewall of the first axial section includes a portion concentrically surrounding the tobacco holder that is larger in diameter than the tobacco holder, and an annular air supply space is defined radially between the tobacco holder and the tubular sidewall of the first axial section.

13. A smoker's pipe according to claim 12, wherein said tubular sidewall includes an air passageway and said elongated sleeve includes an opening that is in alignment with said air passageway when the opening in the elongated sleeve is in alignment with the opening in the tubular sidewall of the first axial section, and a closed portion which covers said air passageway when the closed wall portion of the elongated sleeve covers the opening in the tubular sidewall of the first axial section.

14. A smoker's pipe according to claim 9, comprising a threaded connection between said first axial section and said stem.

15. A smoker's pipe according to claim 4, wherein one of said elongated sleeve and first axial section includes a circumferential slot that is closed at both ends, and the other of said elongated sleeve and first axial section includes a radial pin which fits within said slot, wherein the pin is against one end of the slot when the said axial sections are in said first position, and wherein the pin is against the opposite end of the slot when the axial sections are in said second position, said pin and slot holding the first and second axial sections together in the axial direction.

16. A smoker's pipe according to claim 4, wherein said elongated sleeve includes an outer end portion which extends axially outwardly from said burning zone for tobacco, and wherein a lighter is housed within said outer end portion of the elongated sleeve, said lighter including a first portion and an axially movable second portion, said axially movable portion extending endwise outwardly from the burning zone for tobacco, said first axial section including an abutment that is adjacent the first portion of the lighter when the axial sections are in said first position, said abutment holding said first portion in a fixed position, and wherein an endwise inward push on the axially movable second portion of the lighter will move such second portion relative to the first portion, to ignite a flame, said flame being directed axially inwardly of the bowl.

17. A smoker's pipe according to claim 16, wherein the lighter is rotatable with the second axial section, and when said axial sections are in the second position, a part of the axially movable second portion of the lighter is adjacent the abutment and the first portion of the lighter is positioned away from the abutment.

* * * * *